US005241763A

United States Patent [19]

Dynan

[11] Patent Number: 5,241,763

[45] Date of Patent: Sep. 7, 1993

[54] PLOW ATTACHMENT

[76] Inventor: David R. Dynan, 94 Juniper Dr., Norwood, Mass. 02062

[21] Appl. No.: 809,297

[22] Filed: Dec. 17, 1991

[51] Int. Cl.[5] ..... E02F 3/76

[52] U.S. Cl. ..... 37/407; 37/446; 37/442

[58] Field of Search ..... 37/117.5, 274, 281, 37/118 A, DIG. 3, DIG. 12

[56] References Cited

U.S. PATENT DOCUMENTS 4,306,362 12/1981 Waterman ..... 37/276 X
4,723,609 2/1988 Curtis ..... 37/117.5 X
4,779,363 10/1988 Boutrais et al. ..... 37/117.5
4,813,164 3/1989 Morrell ..... 37/117.5
4,819,349 4/1989 Mensch ..... 37/117.5
4,951,573 8/1990 Madison ..... 37/DIG. 3 X

*Primary Examiner*—Dennis L. Taylor
*Assistant Examiner*—J. Russell McBee
*Attorney, Agent, or Firm*—Iandiorio & Dingman

[57] ABSTRACT

An improved plow attachment includes a mounting plate for mounting to a front end loader bucket or other primary tool or implement; a plow blade; hinge means swingably interconnecting the plow blade and the mounting plate for enabling the plow blade to move between an extended position generally parallel with the front of the bucket and a retracted position generally alongside the bucket; and brace means for securing the plow blade in the extended position.

11 Claims, 3 Drawing Sheets

PLOW ATTACHMENT

FIELD OF INVENTION

This invention relates to an improved plow attachment for mounting to a front end loader bucket or other primary tool or implement, and more particularly to such an attachment which can be easily extended for use as an auxiliary to the primary tool.

BACKGROUND OF INVENTION

Heavy construction equipment such as front end loaders are ideal for snow removal and provide an important source of income for contractors during the slow winter season. Such equipment is more than capable of plowing or pushing a much larger area of snow than defined by the width of the bucket or other primary tool or implement. Conventionally this capability must be taken advantage of by mounting on the bucket a large blade, e.g., 14 feet. However, the removal and replacement of the blade is a difficult and time-consuming task, made more so by the weather naturally occurring when plowing is necessary. In addition, once a large (e.g., 14-foot) blade is attached, driving or transporting the equipment over normal streets is a problem and is generally hazardous.

SUMMARY OF INVENTION

It is therefore an object of this invention to provide an improved plow attachment.

It is a further object of this invention to provide such an improved plow attachment which converts conventional construction equipment into more efficient snow plows.

It is a further object of this invention to provide such an improved plow attachment which is simply and easily installed on conventional equipment.

It is a further object of this invention to provide such an improved plow attachment which does not require the removal of and even enhances the productivity of the equipment including a conventional front end loader bucket or other primary tool or implement.

It is a further object of this invention to provide such an improved plow attachment which can be easily retracted without removal to enable convenient passage on conventional roads and to enable the bucket or other primary tool or implement to be used for its normal functions.

It is a further object of this invention to provide such an improved plow attachment which substantially increases the snow moving capacity of conventional construction equipment.

The invention results from the realization that a simple and effective mechanism for making optimum use of heavy construction equipment for plowing can be achieved with a plow attachment that can be mounted on a front end loader bucket or other primary tool or implement, and hingeably swung between an extended, braced position where it acts as an auxiliary plow and feeder to the primary tool, and a retracted position against the tool.

This invention features an improved plow attachment which includes a mounting plate for mounting to a front end loader bucket or other primary tool or implement. There is a plow blade and hinge means swingably interconnecting the plow blade and the mounting plate for enabling the plow blade to move between an extended position generally parallel to the front of the bucket and a retracted position generally alongside the bucket. Brace means secure the plow blade in the extended position.

In a preferred embodiment the hinge means may include a hinge bracket on the plow, a hinge bracket on the plate, a hinge pin for joining the brackets, and compensation means for enabling the blade to adjust to uneven terrain. The compensation means may include hinge pins loosely fitted to the bracket. The brace may include a bushing at either end, pivot brackets, one on the blade and one on the plate, for engaging the bushings, and brace pins for engaging one each of the brackets and bushings. The brackets may be horizontally aligned and vertically offset from each other for engaging each other and receiving a pin for securing the blade in the retracted position against the plate. The hinge means may include means for raising the plow blade as it moves from the extended to the retracted position. The means for raising may include complementing mating camming surfaces on the hinge brackets for raising the plow blade as it moves from the extended to the retracted position. The brace means may include hydraulic means for positioning the plow blade in the retracted, extended or intermediate positions. The brace means may include means for adjusting the angle of the plow blade to positions leading or lagging the primary tool. The plow blade may include storage means for carrying the brace means when the blade is in the retracted position.

The invention also features an improved plow attachment system comprising a pair of plow attachments, each including a mounting plate for mounting to a front end loader bucket or other primary tool or implement, a plow blade, and hinge means swingably interconnecting the plow blade and mounting plate for enabling the plow blade to move between an extended position generally parallel to the front of the bucket and a retracted position generally alongside the bucket, with brace means for securing the plow blade in the extended position.

DISCLOSURE OF PREFERRED EMBODIMENT

Other objects, features and advantages will occur to those skilled in the art from the following description of a preferred embodiment and the accompanying drawings, in which.

Figure 1:
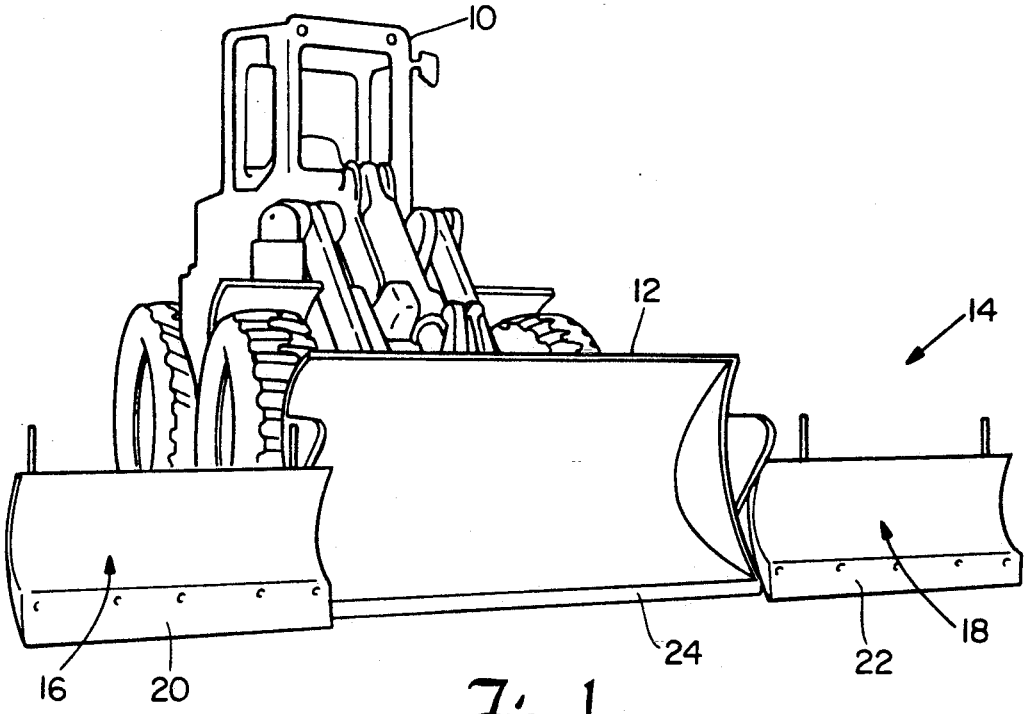
FIG. 1 is a three-dimensional front view of a front loader with an improved plow attachment system including two plow attachments mounted on the bucket.

The invention may be accomplished with an improved plow attachment which can be used typically with heavy construction equipment in order to increase its efficiency in plowing lighter materials such as snow. The plow attachments can be used singly on one side of a front end loader bucket or other primary tool or implement used by a piece of equipment, or may be used in pairs on both sides of such a tool or implement. There is a mounting plate for mounting to the front end loader bucket or other primary tool or implement, and a plow blade of a conventional type. There are hinge means which swingably interconnect the plow blade and the mounting plate to enable the plow blade to move between an extended position generally parallel to the front of the bucket and a retracted position generally alongside the bucket.

Further, the angle magnitude subtended at the hinge means by a radial line originating from the hinge means and rotating outward from a point abutting the primary tool plow blade to a point abutting the attachment plow blade is roughly 180° in the extended operational position and roughly 270° in the retracted storage position.

In the extended position the plow blade may lead or lag somewhat with regard to the face of the primary tool or implement. There is a brace for securing the plow blade in its position generally aligned with the primary tool, whether that position be strictly aligned or somewhat leading or somewhat lagging. The hinge means may include hinge brackets mounted on the plow and on the plate, and a hinge pin for joining the brackets. Compensation means can be provided to enable the blade to jiggle up and down in order to adjust to uneven terrain. This compensation means may include using hinge pins which are loosely fitted to the brackets. The brace may include a bar with a bushing at either end that mates with pivot brackets, one on the blade and one on the plate. Brace pins can then be used for engaging each of the brackets with each of the bushings. Conveniently, the brackets may be horizontally aligned: that is, they may be both spaced the same distance from the hinge point, but offset from each other vertically, so that when the blade is brought back into the retracted position against the plate the holes align and can receive a pin for securing the blade in the retracted position. This is convenient when the machine has to be driven or transported on public roads, and it is also convenient when the plow blades are not being used but the bucket or other tool is desired to be used without interference from the extended blades.

The hinge means can include means for raising the plow blade as it moves from the extended to the retracted position in order to be sure that there is no interference from the blades if the primary tool is to be used independently. The means for raising may include complementary mating cam surfaces on the hinge means so that the plow blade is gently driven upward as it moves from the extended to the retracted position. The brace may be a single bar or may include hydraulic means for positioning the plow blade in the retracted, extended or any intermediate positions. If a hydraulic means is included in the brace, then the plow blade is easily adjusted to positions which lead or lag the primary tool. If the brace is a simple bar, additional brackets may be spaced along the back of the plow blade so that the brace bushing can be pinned to the closer brackets to place the plow blade in a leading position and can be engaged with the brackets farther along the plow for positioning the plow blade in the more lagging positions. The plow blade may include storage means for carrying the brace means when the blade is in the retracted position.

Figure 2:
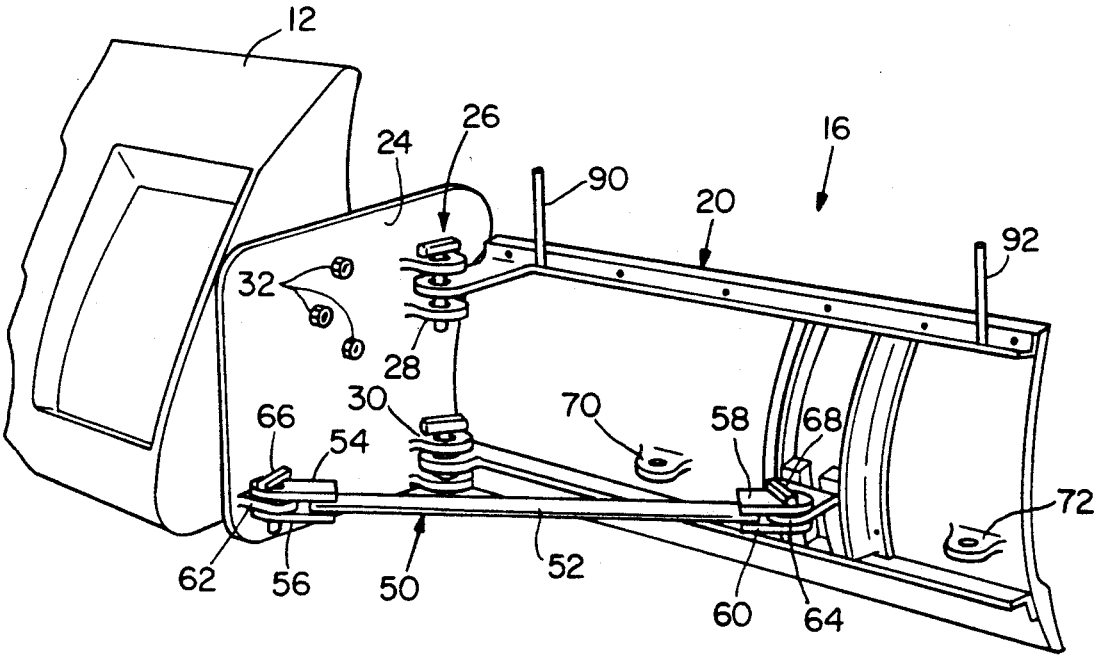
FIG. 2 is a three-dimensional rear view of the right plow blade of FIG. 1.
Figure 3:
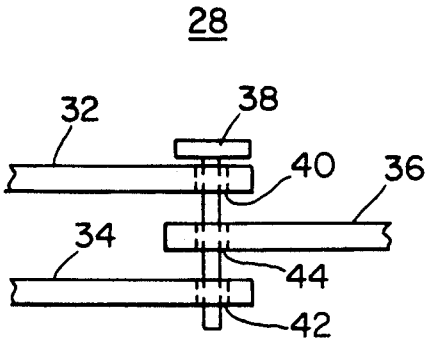
FIG. 3 is an enlarged detail view showing a hinge pin loosely fitted in the hinge brackets that interconnect the plow blade and mounting plate of FIG. 2.
Figure 5:
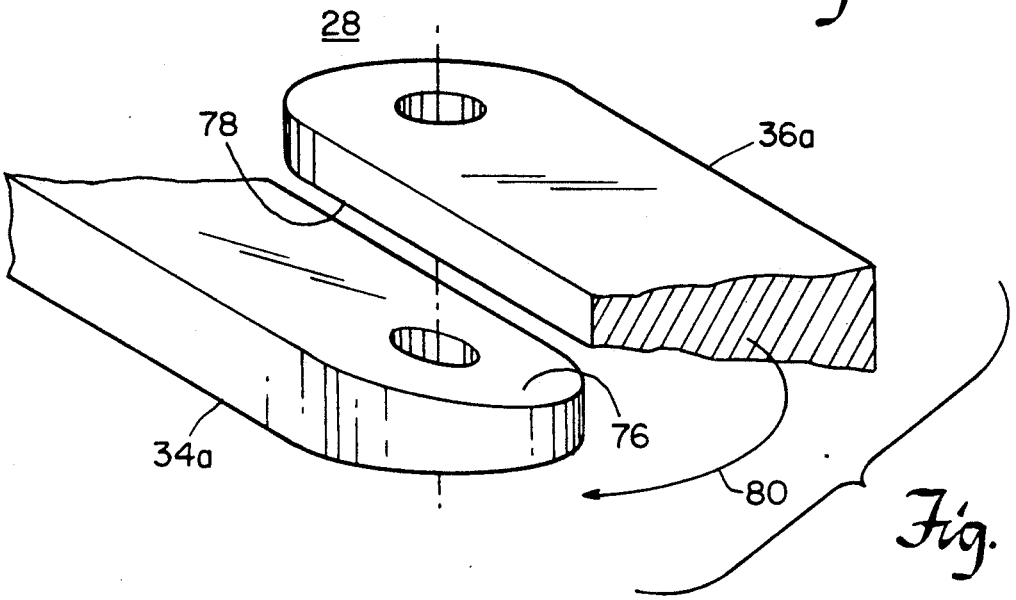
FIG. 5 is an enlarged detail view of the hinge camming surfaces for raising the plow blade as it is retracted.

There is shown in FIG. 1 a front end loader 10 having a bucket 12 primary tool including a plow blade 24, attached to which is an improved plow attachment system 14 including two plow attachments 16 and 18. Each plow attachment includes a plow blade 20, 22. Each plow attachment, as exemplified with respect to the right-hand plow 20, FIG. 2, includes a mounting plate 24 and hinge means 26, which includes a pair of hinges 28 and 30. Mounting plate 24 is mounted to bucket 12 by means of a number of conventional bolts and nuts 32. Hinge means 28 and 30, as exemplified with respect to hinge means 28, FIG. 3, may include a pair of brackets 32, 34 attached to mounting plate 24, and a bracket 36 mounted to plow blade 20. Pins 38 loosely fitted in holes 40, 42 and 44 enable the plow to move up and down to compensate for uneven terrain. Plow blade 20 is secured in the extended position, as shown in FIG. 2, by means of brace 50 which includes a bar 52 having a pair of spaced bushings 54, 56 and 58, 60 at either end. Bushings 54 and 56 align with brace bracket 62 on mounting plate 24, and brace bushings 58 and 60 align with brace bracket 64 on plow blade 20. Pins 66 and 68 pin together the respective bushings and brackets. If in the extended position the plow blade 20 is desired to be set at a somewhat leading position so that it drives the snow or other material into the central tool or bucket, then bushings 58 and 60 can be engaged with inner bracket 70. If, on the other hand, plow blade 20 is desired to be placed in the lagging position, bushings 58 and 60 may be engaged with outer bracket 72. Hinge means 28 and 30 may be constructed as shown in FIG. 5, where brackets 34*a* and 36*a* include complementary mating camming surfaces 76 and 78 which provide an incline to raise plow blade 20 as bracket 36*a* pivots in the direction of arrow 80 with respect to bracket 34*a*.

Figure 4:
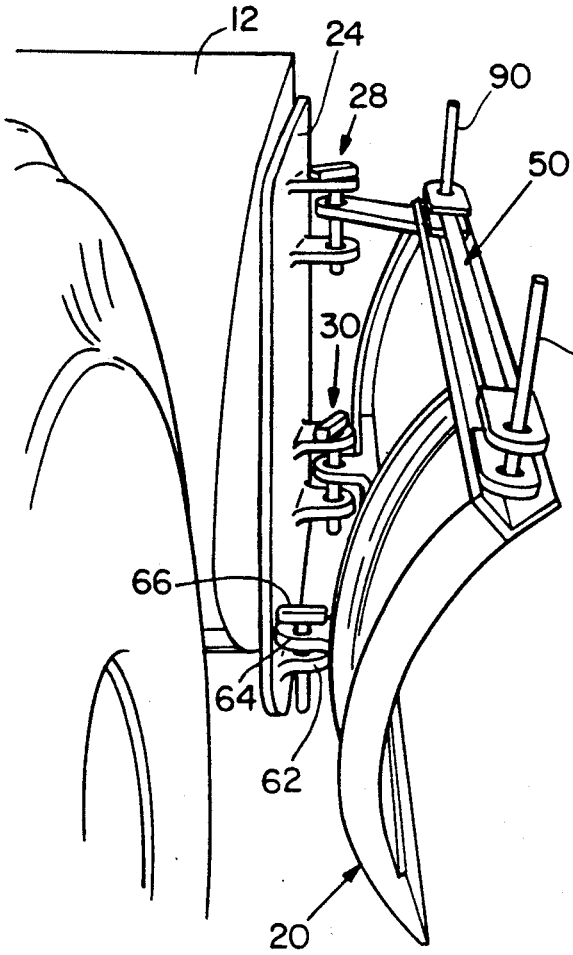
FIG. 4 is a view similar to FIG. 2 with the right plow blade in the retracted position.

When it is desired to place plow blade 20, FIG. 2, in the retracted position, pins 62 and 64 are removed and brace 50 can then be stored on storage pins 90, 92, FIG. 2, on the top of plow blade 20, as shown in FIG. 4. Plow blade 20 can then be swung all the way back against mounting plate 24, FIG. 4. Bracket 62 on mounting plate 24 and bracket 64 on plow blade 20 are mounted the same distance apart from hinges 28 and 30, but vertically offset so that bracket 62 is slightly higher than bracket 64. Thus when plow blade 20 is in the retracted position against mounting plate 24, as shown in FIG. 4, a pin such as pin 66 may be used to engage both bracket 62 and 64 and secure plow blade 20 in the retracted position. Alternatively, bracket 70 or 72 could be set to so align with bracket 62.

Figure 6:
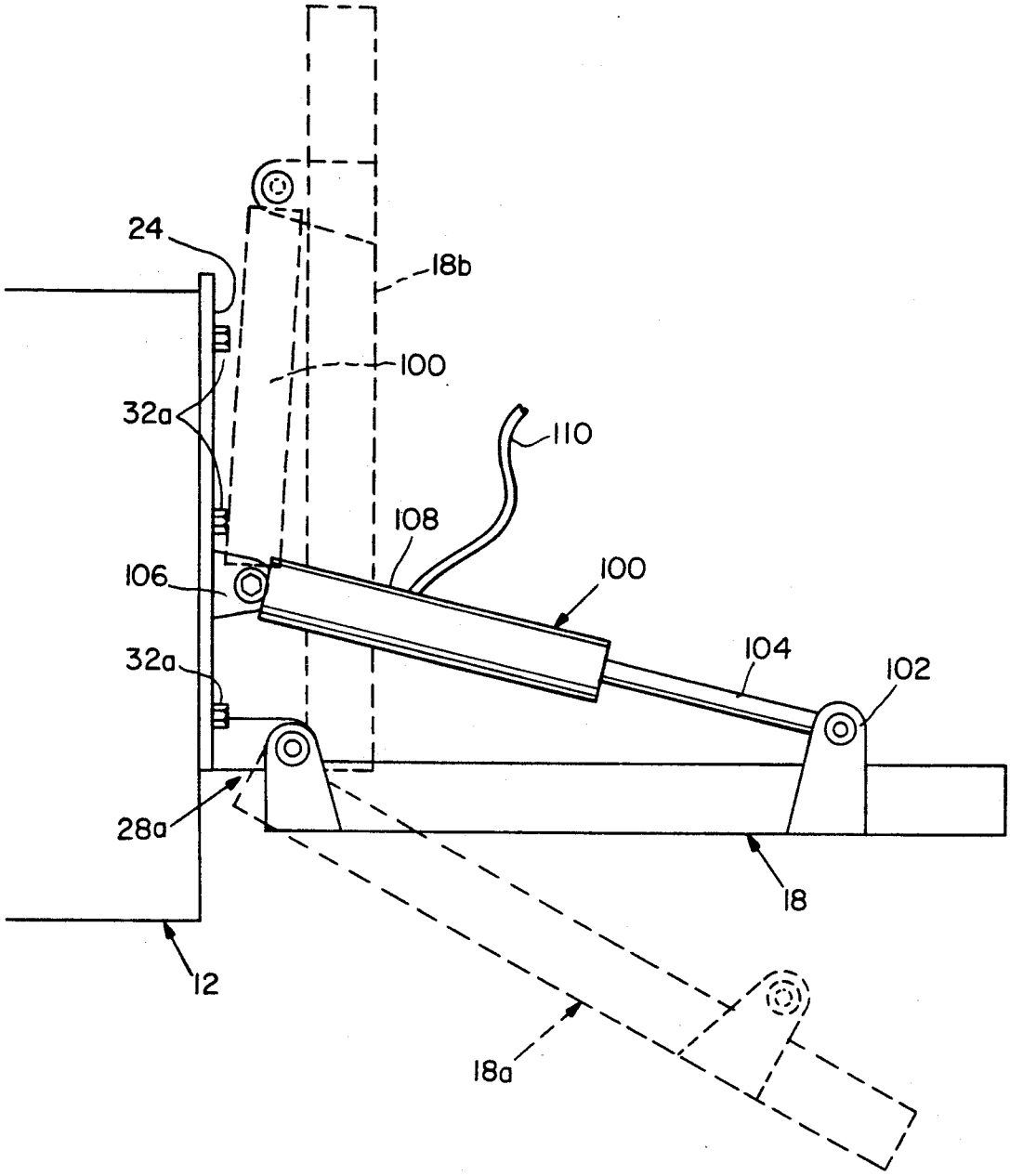
FIG. 6 is a top plan view of a plow attachment according to this invention using a hydraulic actuator for bracing and positioning the plow blade.

Instead of a rigid link, brace 50 may be implemented, at least in part, using a hydraulic cylinder 100, FIG. 6, where plow blade 18 is shown including a bracket 102 which engages the piston 104 of hydraulic actuator 100, while a similar bracket 106 on mounting plate 24 secures the hydraulic cylinder 108. Hydraulic actuator 100 can then be operated through suitable hydraulic hoses 110 so that plow blade 18 can be positioned either in the extended position generally parallel to bucket 12, more or less aligned with it, as shown in full lines, or in a leading position as shown in phantom 18*a*, in a lagging position, not shown, or in a retracted position, as shown in phantom at 18*b*.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. An improved plow attachment system comprising:
a mounting plate for mounting to the side of a front end loader primary tool having a plow blade;
a plow attachment having a plow blade;
hinge means swingably interconnecting said plow attachment and mounting plate for enabling said attachment plow blade to move between an extended operational position generally parallel with the primary tool plow blade and a retracted storage position generally alongside the mounting plate, where the angle magnitude subtended at said hinge means by a radial line originating from said hinge means and rotating outward from a point abutting the primary tool plow blade to a point abutting the attachment plow blade is roughly 180° in the extended operational position and roughly 270° in the retracted storage position; and brace means for securing the attachment plow blade in the extended position.

2. The plow attachment system of claim 1 in which said hinge means includes a hinge bracket on said plow attachment, a hinge bracket on the plate, a hinge pin for joining said brackets and compensation means for enabling said attachment plow blade to adjust to uneven terrain.

3. The plow attachment system of claim 2 in which said compensation means includes said hinge pin loosely fitted to said brackets.

4. The plow attachment system of claim 1 in which said brace includes a bushing at either end, pivot brackets one on said plow attachment and one on said plate for engaging said bushings, and brace pins for engaging one each of said brackets and bushings.

5. The plow attachment system of claim 4 in which said brackets are horizontally aligned and vertically offset from each other for engaging each other and receiving a pin for securing said plow attachment in the retracted position against said plate.

6. The plow attachment system of claim 2 in which said hinge means include means for raising said attachment plow blade as it moves from the extended to the retracted position.

7. The plow attachment system of claim 6 in which said means for raising includes complementary mating camming surfaces on said hinge.

8. The plow attachment system of claim 1 in which said brace means included hydraulic means for positioning said attachment plow blade in the retracted, the extended or intermediate positions, located an angular distance from the retracted position that is less than the angular distance between the retracted and extended positions.

9. The plow attachment system of claim 1 in which said brace means includes means for increasing or decreasing the extended angular distance of the attachment plow blade.

10. The plow attachment system of claim 4 in which said blade includes storage means for carrying said brace means when said blade is in the retracted position.

11. An improved plow attachment system comprising:
a pair of plow attachments each including:
a mounting plate for mounting to a front end loader primary tool having a plow blade;
a plow attachment having a plow blade;
hinge means swingably interconnecting said plow attachment and mounting plate for enabling said attachment plow blade to move between an extended operational position generally parallel with the primary tool plow blade and a retracted storage position generally alongside the mounting plate; where the angle magnitude subtended at said hinge means by a radial line originating from said hinge means and rotating outward from a point abutting the primary tool plow blade to a point abutting the attachment plow blade is roughly 180° in the extended operational position and roughly 270° in the retracted storage position; and brace means for securing the attachment plow blade in the extended position.

* * * * *